US006064047A

United States Patent [19]

Izzo

[11] Patent Number: 6,064,047

[45] Date of Patent: May 16, 2000

[54] MICROWAVE HOT WATER BOILER HEATING SYSTEM

[76] Inventor: Daniel R. Izzo, 512 Onondaga Ave., Syracuse, N.Y. 13207

[21] Appl. No.: 08/766,130

[22] Filed: Dec. 16, 1996

[51] Int. Cl.[7] ..... H05B 6/80

[52] U.S. Cl. ..... 219/688; 219/687; 219/759; 392/320

[58] Field of Search ..... 219/688, 687, 219/759, 682; 392/314, 320, 324, 339, 341, 342

[56] References Cited

U.S. PATENT DOCUMENTS

| | | | |
|---|---|---|---|
| 3,891,817 | 6/1975 | Brown | 219/688 |
| 4,114,011 | 9/1978 | Stubbs | 219/688 |
| 4,358,652 | 11/1982 | Kaarup | 219/688 |

FOREIGN PATENT DOCUMENTS

| | | | |
|---|---|---|---|
| 2 531 190 | 2/1984 | France | 219/688 |
| 29 28 520 | 1/1981 | Germany | 219/688 |

*Primary Examiner*—Philip H. Leung

[57] ABSTRACT

A Microwave Hot Water Boiler Heating System includes a water tank with a water boiler circulator and a water refill valve and a water drain valve and a cooled water pipe that comes from the steam cooling chamber. A vacuum pump is employed to depressurize the boiler tank and vacuum pump the steam that is produced by the heated water that was heated by the microwaves coming directly from the magnetron maser. Vacuum pumping the steam from the microwave boiler heating area prevents the pressurization of steam that would damage the machine's magnetron maser. The vacuum pump also will, by its force, draw in air from the boiler tank's air inlet/overflow valve and by its force contain and compress the steam inside of the machine's steam chamber. Both, the water boiler tank and the steam chamber shall have a closed loop of coiled piping that will transfer heat to a room radiator heat exchanger. The closed loop of piping shall be filled with circulating water that is circulated by a circulator pump. Inside of the steam chamber shall be pressure reducing valves that allow for the release of either cooled water or steam. The machine's microwave emitting magnetron maser will operate upon command by a room air temperature sensor/thermostat.

2 Claims, 2 Drawing Sheets

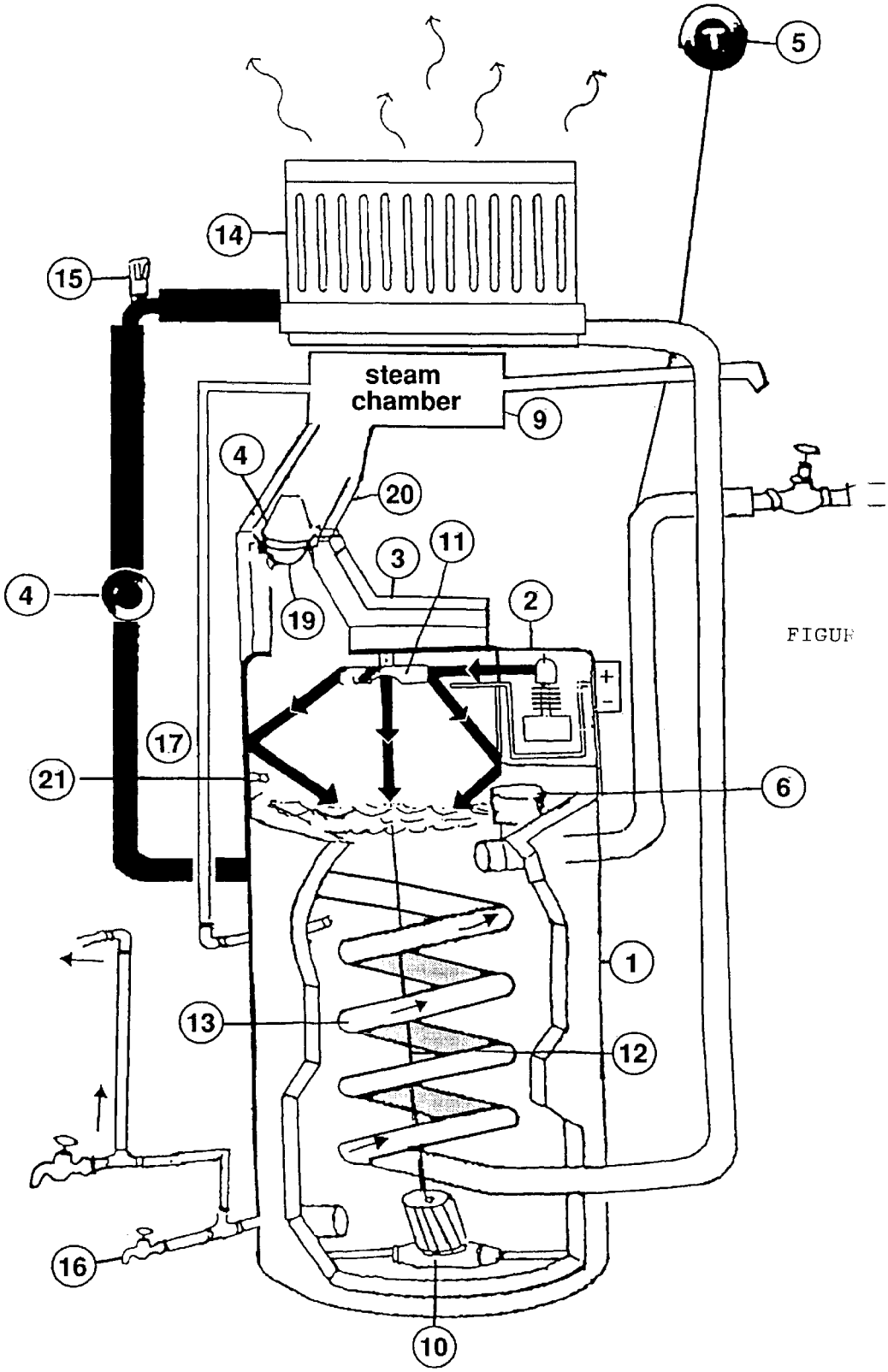
FIGUR (1).

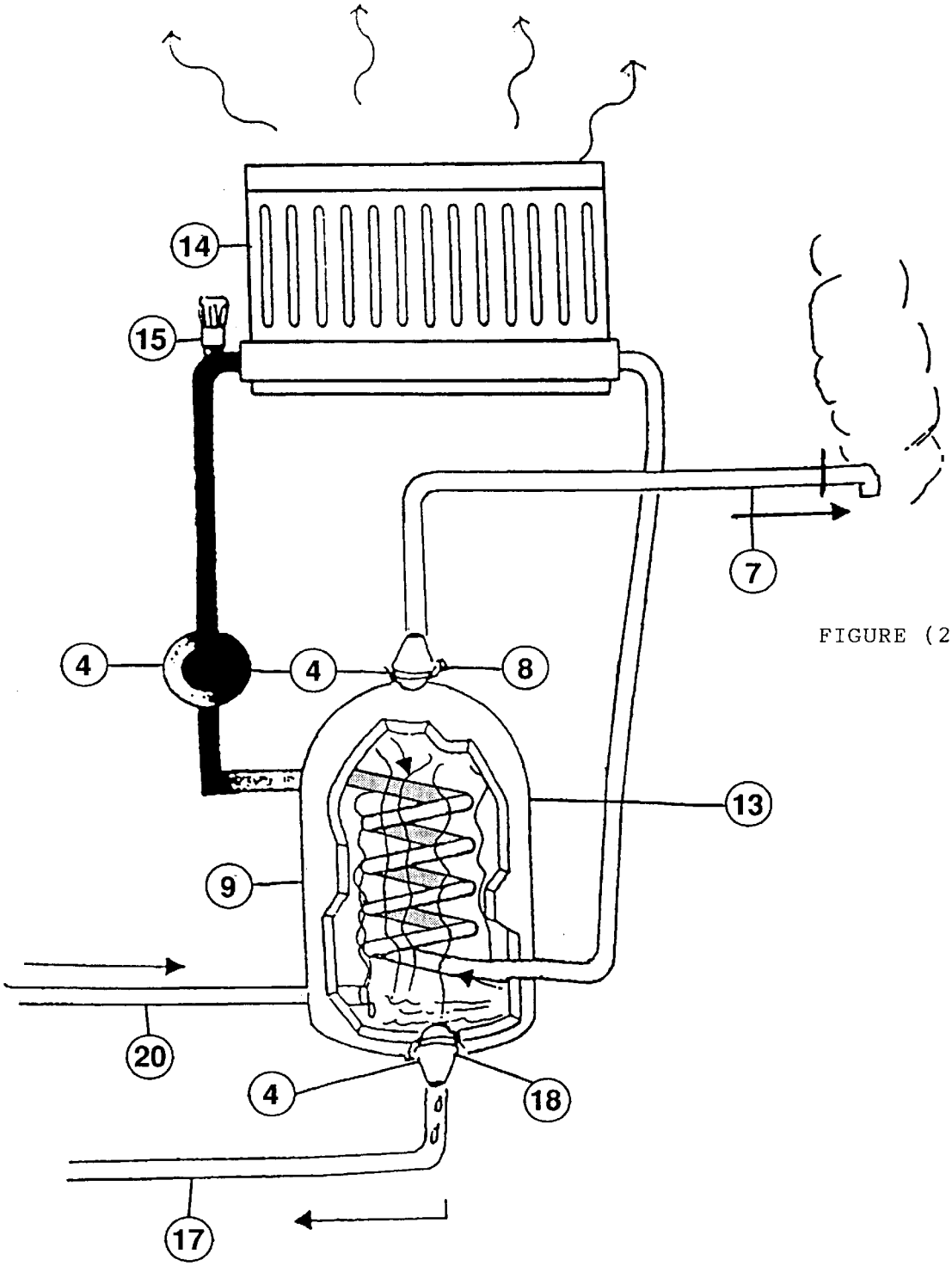
FIGURE (2).

MICROWAVE HOT WATER BOILER HEATING SYSTEM

FIELD OF THE INVENTION

The Microwave Hot Water Boiler Heating System can be used for heating a room in a building that is in need of heat. The invention operates like most steam producing water boiler systems but this invention heats its water with microwave energy directly and then vacuum pumps its steam into a steam chamber for cooling.

BACKGROUND OF THE INVENTION

Hot water boiler heating systems provide a clean and comfortable source of building heat that will also keep room air most in the drier winter months. Accordingly it is the object of the invention to provide an improved and novel source of building heat in the invention, A Microwave Hot Water Boiler Heating System, in that it is new and different, in that it uses microwaves to heat water inside a water boiler tank directly with microwaves, in a pressure free environment that also circulates water in its heating tank and vacuum pumps the produced steam into a pressurized steam chamber. The steam chamber is also used for building heat and returns the cooled steam chamber water into the pressure free water tank for microwave reheating, thus making the machine more efficient.

A major problem with microwave water boiler heating is that if too much water vapor or steam condenses upon, and steam pressure builds up against the machine's microwave emitting magnetron maser it would cause it to explode and damage the entire unit.

Some of the deficiencies of other microwave energy heating systems are that they are not able to heat water or fluid at a high pressure temperature because the pressure would damage the translucent to microwave wall that is needed to protect and separate the microwave emitting apparatus and the heated water and steam so that the unit will not short circuit and break down.

Another objective of the invention is to allow for heating water in the boiler tank at high temperatures in a pressure free environment so that the magnetron maser will not be damaged and can heat the water in the tank with microwaves directly.

SUMMARY OF THE INVENTION

This invention relates to an improved hot water boiler heating system that is designed for heating buildings and rooms in a building in need of heat from bulk hot water inside of a tank that was heated with microwave energy that is directly emitted at the water in the tank. As a result of heating water in this manner, steam is produced, this steam is then vacuum pumped into a steam chamber and allowed to cool back into liquid water and returned back into the microwave heating area, water tank, for re-heating again with microwaves that are directly emitted at the water in the water tank.

BRIEF DESCRIPTION OF THE DRAWINGS

FIG. #1. is an overall view of a microwave fluid heater of the present invention; and FIG. #2 is an enlarged view showing the details of the steam chamber of FIG. 1.

A DESCRIPTION OF THE DRAWING OF THE INVENTION

The Microwave Hot Water Boiler Heating System consists of a water tank (1) A magnetron maser that will emit microwaves and its electric transformer (2) and obtains its needed electric current from a public or private electric power generation system. The magnetron is triggered to turn on and off together with other electric devices like the reflector fan motor/water boiler circulator (3) the pumps and valves (4) by a thermostat that is located in a room of a building (5) and is connected to the power transformer. The flush valve (6) is used to refill the water tank (1) when water runs to a lower filling level because of the steam released into the outside air flue (7) caused by the opening of the steam chamber's pressure reducing pressure reducing valve (8) that is located on top of the steam chamber (9). The water circulator (10) is connected to the reflector fan (11) by a shaft (12) located in the middle of the water tank (1) and the coiled heat exchanger (13) that is hollow and filled with fluid and is a tube or pipe that extends out of the water tank (1) and connects to a room radiator (14) and has an electric water or fluid circulator pump (4) and an optional control/refill valve (15) near the room radiator (14). The machine shall have a boiler drain and a main hot water line (16) at the bottom of the water tank (1). The cooled water flow back pipe (17) will allow cooled water to enter the water tank (1) from the steam chamber (9) by a pressure valve (18) that is on the bottom of the steam chamber (9). The vacuum pump (19) pumps steam through the steam flue pipe (20) and draws outside air in at the vacuum air inlet/overflow valve (21). The steam chamber (9) includes a connection to the steam flue pipe (20) with a pressure reducing valve (4) and another connection to the cooled water flow back pipe (4) with a pressure valve at the bottom (18). The steam chamber (9) will be a hollow and seperate from the water heating tank (1) and will have a coiled fluid filled heat exchanger (13) inside of it (9) where steam is held and forced in by vacuum pump (19). The coiled steam chamber pipe heat exchanger (13) shall be connected to another room radiator by way of a hollow fluid filled tubing (14) and it will have its fluid circulated by a pump (4) and will also have a connection to a roan radiator for building heat.

I claim:

1. A microwave water boiler heating system that heats water and produces steam vapor for heating a room, comprising;

a water container for containing water therein; means for heating the water within said container, including a source of microwave energy within said container and being control by a room thermostat;

a coiled heat exchanger within said container for circulating heated water being and connected to a room radiator-heat exchanger, forming a closed loop; a water refill valve that supplies water into said container; a rotating reflector fan for reflecting the microwave energy and for rotation to circulate the heated water within said container;

a steam chamber for containing steam and vaporized water therein;

a vacuum pump for evacuating steam and vaporized water from within the container;

wherein the vacuum pump removes steam and water vapor from the water container and is connected by a vacuum pipe;

a release valve within said steam chamber for releasing steam into a steam flue and a cooled water vapor valve within said steam chamber that connects into the said water container for releasing the cooled water into the water container; and an air valve within said container for drawing air into the container and also functioning as an over flow valve; and an outlet valve for obtaining hot water from within said water container.

2. A water boiler heating system for heating a room, comprising a water container for containing water therein;

a source of electro-magnetic radiation for heating water within the container, a coiled heat exchanger within the container connectable to a room radiator, a steam chamber connected to the container for containing steam and vaporized water, a vacuum pump connected to the steam chamber for evacuating steam and vaporized water from within the container into the steam chamber; and means for releasing steam in the steam chamber into a steam flue.

* * * * *